US008124878B2

(12) United States Patent
Hoppe et al.

(10) Patent No.: US 8,124,878 B2
(45) Date of Patent: Feb. 28, 2012

(54) APPARATUS FOR ELECTRICAL SCREENING OF A HIGH-VOLTAGE BUSHING

(75) Inventors: Jens Hoppe, Schwarzenbruck (DE); Dietmar Jahnel, Troisdorf (DE); Johann Schlager, Nürnberg (DE)

(73) Assignee: Siemens Aktiengesellschaft, Munich (DE)

( * ) Notice: Subject to any disclaimer, the term of this patent is extended or adjusted under 35 U.S.C. 154(b) by 484 days.

(21) Appl. No.: 12/376,197

(22) PCT Filed: Jul. 26, 2007

(86) PCT No.: PCT/EP2007/057701

§ 371 (c)(1), (2), (4) Date: Feb. 3, 2009

(87) PCT Pub. No.: WO2008/015150

PCT Pub. Date: Feb. 7, 2008

(65) Prior Publication Data

US 2010/0065304 A1 Mar. 18, 2010

(30) Foreign Application Priority Data

Aug. 3, 2006 (DE) ..... 10 2006 038 221

(51) Int. Cl.

| | |
|---|---|
| ***H01B 17/20*** | (2006.01) |
| ***H01B 17/42*** | (2006.01) |
| ***H01B 17/44*** | (2006.01) |
| ***H01B 17/46*** | (2006.01) |
| ***H01B 17/48*** | (2006.01) |

(52) U.S. Cl. ..... 174/152 R; 174/152 G; 174/153 G; 174/135; 174/142; 174/140 CR; 174/141 R; 174/140 C; 174/140 H

(58) Field of Classification Search ..... 174/152 G, 174/152 R, 153 G, 135, 142, 144, 141 R, 174/140 R, 140 CR, 140 H; *H01B 17/26, H01B 17/46, 17/44, 17/42*

See application file for complete search history.

(56) References Cited

U.S. PATENT DOCUMENTS

| | | | | |
|---|---|---|---|---|
| 2,986,595 | A * | 5/1961 | Fiero et al. | 174/178 |
| 3,173,115 | A | 3/1965 | Peuron | |
| 3,673,305 | A * | 6/1972 | Mashikian et al. | 174/12 BH |
| 4,296,274 | A | 10/1981 | Cookson | |

(Continued)

FOREIGN PATENT DOCUMENTS

| | | |
|---|---|---|
| CH | 413030 A | 5/1966 |

(Continued)

OTHER PUBLICATIONS

Translation of JP53054798, Menju et al, Bushing, p. 3 upper right col. lines 13-19.*

*Primary Examiner* — Quyen Leung
*Assistant Examiner* — Terrance Kenerly
(74) *Attorney, Agent, or Firm* — Laurence A. Greenberg; Werner H. Stemer; Ralph E. Locher

(57) ABSTRACT

An apparatus for electrical screening of a bushing output of a high-voltage line into an outer wall of an electrical high-voltage device, includes an electrically conductive screen interior and an outer insulation layer, which surrounds the screen interior. A curved circular segment with two limbs in conjunction with a correspondingly shaped barrier system ensures virtually complete electrical screening of corners and edges of a bushing output.

14 Claims, 1 Drawing Sheet

U.S. PATENT DOCUMENTS

| | | | | |
|---|---|---|---|---|
| 5,130,495 | A * | 7/1992 | Thompson | 174/73.1 |
| 6,218,627 | B1 * | 4/2001 | Shindo et al. | 174/167 |
| 6,346,677 | B1 | 2/2002 | Guillemette et al. | |
| 2001/0022230 | A1 * | 9/2001 | Kaplo | 174/35 R |
| 2005/0199418 | A1 * | 9/2005 | Donzel et al. | 174/142 |

FOREIGN PATENT DOCUMENTS

| | | | |
|---|---|---|---|
| DE | 1438666 | A1 | 12/1969 |
| DE | 246402 | A1 | 6/1987 |
| JP | 53054798 | * | 6/1978 |
| WO | 0019453 | A1 | 4/2000 |

* cited by examiner

APPARATUS FOR ELECTRICAL SCREENING OF A HIGH-VOLTAGE BUSHING

BACKGROUND OF THE INVENTION

Field of the Invention

The invention relates to an apparatus for electrical screening of a bushing output of a high-voltage line into the outer wall of an electrical high-voltage device, with the screen comprising an electrically conductive screen interior and an outer insulating layer which surrounds the screen interior.

With electrical high-voltage devices, such as power transformers for example, it must be guaranteed that there is adequate electrical screening in the region of the electrical connection and the transition of the electrical line into the high-voltage device in order to allow electrical connection to a high-voltage network. Particularly in the case of high-voltage direct current (HVDC transmission) equipment, it is absolutely essential that the bushing and the wall of the electrical high-voltage device facing the bushing are adequately electrically screened. Adequately electrically screened means a reduction in the electrical field strength which occurs on the surface of the screen and in the surrounding space.

According to the prior art, for reasons of high-voltage screening, the edge transitions and corners between the bushing of the high-voltage line and the wall of the tank perpendicular thereto are screened in such a way that a so-called screen wire is arranged around the bushing outlet within the electrical high-voltage device. Traditionally, this screen wire is provided with an electrically conducting screen interior which is electrically insulated on the surface, in particular by a paper insulation. In variance with this, differently formed screening rings, which have a rectangular electrically conducting screen interior, are also disclosed in the prior art.

U.S. Pat. No. 4,296,274, for example, describes a high-voltage bushing, which has a weather-tight screen. According to this invention, an advantageous guiding of the electrical field is achieved by additionally thickening the appropriate transition region of the bushing.

Likewise WO 00/19453 describes a high-voltage bushing with a high-voltage conductor in an insulator equipped with insulating screens, which has a flange on one end through which the high-voltage line is fed, an insulation medium being provided between flange and high-voltage conductor. In addition, a screen electrode is arranged around the insulator which extends from the flange in an axial direction over part of the length of the insulator, the number of insulating screens per unit length being different in the individual sections.

A disadvantage of all the screening solutions for high-voltage bushings disclosed in the prior art is that the previous solutions are either structurally elaborate or do not guarantee complete screening of the almost right-angled bushing output. In particular, the electrical screening of the almost right-angled corners and edges of the bushing output relative to the tank wall is not fully guaranteed by the solutions provided in the prior art.

BRIEF SUMMARY OF THE INVENTION

The object of the present invention is therefore to provide an electrical screen, which guarantees complete screening of the corners and edges of a bushing output in an electrical high-voltage device.

This object is achieved by an apparatus for electrical screening of an almost right-angled bushing output of a high-voltage line into an outer wall of an electrical high-voltage device. The screen comprises an electrically conductive screen interior and an outer insulating layer which surrounds the screen interior. The screen is arranged in the form of a curved circular segment around the almost right-angled bushing output and the limbs are arranged almost parallel to the alignment of the bushing and to the alignment of the tank wall. According to the invention, the object is achieved in that the screen is designed in the form of a curved circular segment around the almost right-angled outlet of the bushing. This guarantees that the field characteristic of the electrical field is changed in the vicinity of the almost right-angled bushing output. Traditionally, the field characteristic of the electrical field has a high degree of complexity in the vicinity of corners and edges, and has previously only been inadequately ensured by an electrical screen. However, by means of the apparatus according to the invention, it is possible to influence the characteristic of the electrical field in the vicinity of the corners and edges so that an almost complete screening of the corners and edges is guaranteed in the vicinity of the bushing output. The embodiment of the electrical screen according to the invention in the form of a curved circular segment with two long limbs influences the characteristic of the electrical field in the area surrounding the bushing output in such a way that the housing of the electrical high-voltage device is completely electrically screened in the area of the bushing output.

In an advantageous embodiment of the apparatus according to the invention, the electrical screen is positioned around the almost right-angled bushing output so that the radius of the curved circular segment runs through the corner of the almost right-angled bushing output. As a result of this, the screen is positioned symmetrically with respect to the two edges of the almost right-angled bushing output.

Furthermore, in an advantageous embodiment of the apparatus according to the invention, it is provided that the form of the screen corresponds to an idealized field characteristic of the electrical field in the area around the bushing output.

Advantageously, it is provided that the radius of the curved circular segment of the screen is less than four times the length of the limbs. This guarantees screening of the appropriate corners and edges of the bushing output from all sides. Likewise, the radius preferably has a length of 10 mm to 500 mm, preferably 100 mm. In an advantageous embodiment of the apparatus, it is provided that the screen is screened by an additional barrier system. These barrier systems, which are already used with line bushings, are likewise combined with the screen according to the invention in the form of a screening barrier system around the output of the bushing. An effective electrical screening of the corners and edges of the bushing output with respect to the outer wall of the electrical high-voltage device is guaranteed, particularly for HVDC transmission applications, because of the high transmission voltages possible. Advantageously, the barrier system is mechanically connected to the barrier system of the bushing and/or the barrier system of the electrical high-voltage device.

It is seen to be an advantage that the screen is formed around the bushing output as a circumferential one-piece element. This means that the screen can be produced cost effectively and results in a dimensionally stable effect of the screen. Alternatively, it is provided that individual screen segments are arranged in the form of a circle around the bushing output. The same applies to an appropriate barrier system for additional screening. Advantageously, the screen is connected to the electrical ground.

Furthermore, it is possible to use this electrical screen simultaneously as a magnetic screen if the screen is made from conductive material. Local heating caused by eddy currents, which can lead to considerable heating and possibly damage to the electrical high-voltage device, would then be prevented. Advantageously, the screen consists at least partially of conductive material which is partially interspersed with non-conductive material.

Furthermore, in an advantageous embodiment of the apparatus, the screen consists of a carrier material, which is at least partially sheathed, in particular coated or sheathed, with a conductive layer.

Further advantageous embodiments of the invention can be found in the dependent claims. The invention is explained in more detail in the drawing with reference to the exemplary embodiments. In the drawing:

DESCRIPTION OF THE INVENTION

Figure 1:
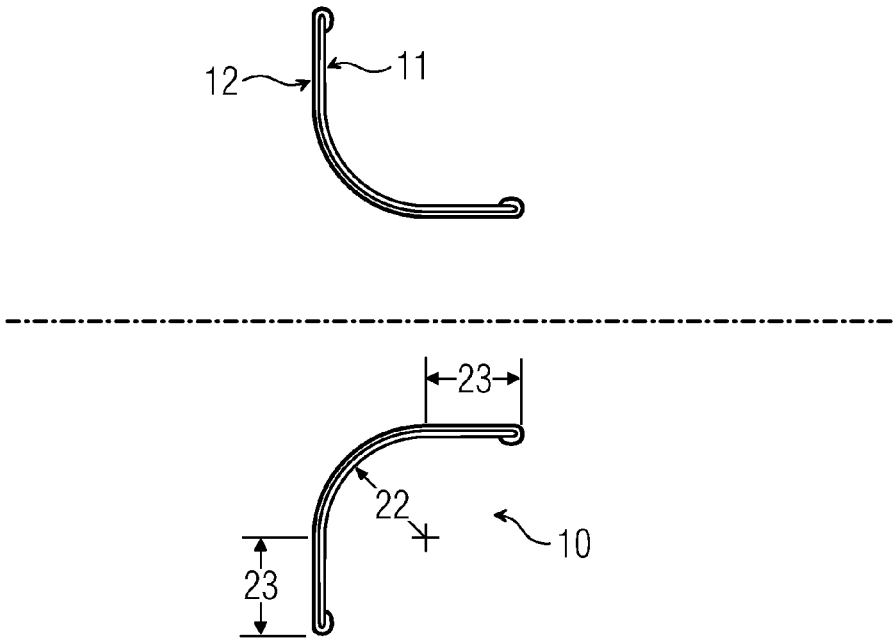
FIG. 1 shows a schematic section drawing of the screen.

FIG. 1 shows a schematic section drawing of the structure of the screen 10 according to the invention in principle. The dotted line represents the axis of rotation of the screen 10. The screen interior 11 is insulated, at least with respect to the inside of the electrical high-voltage device, with an additional insulation layer 12. Traditionally, this is a paper insulation. An insulation medium, in particular an oil, is provided within the electrical high-voltage device in the area around the screen 10. The screen 10, which is arranged almost at right angles around a bushing output (not shown), has two limbs 23 which are part of the curved circular segment. The length of the limbs is defined with regard to the transition of the curved circular segment to the straight limbs 23 in each case. The radius 22 defines the form of the curved circular segment of the screen 10 and runs through the corner (not shown) of the line bushing output 21 (not shown).

Figure 2:
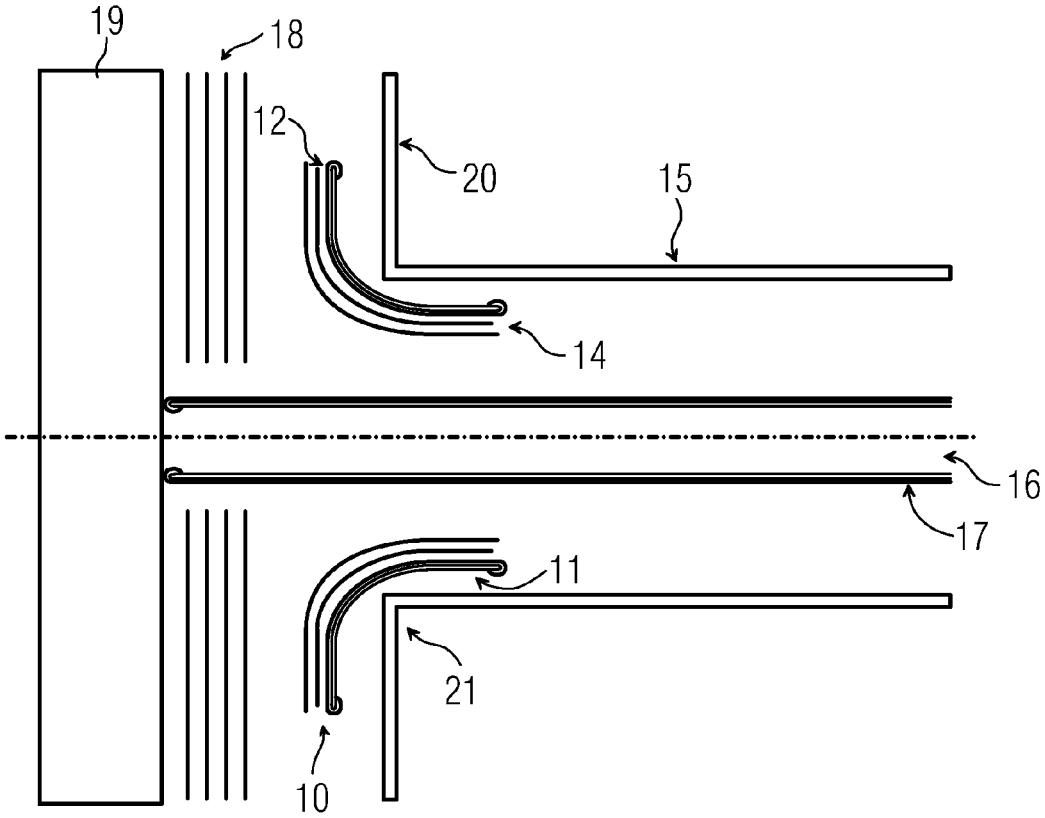
FIG. 2 shows a schematic section drawing of the screen around a line bushing with additional barrier systems.

FIG. 2 shows a screen 10 with an additional barrier system 14 around a bushing output 21 for an electrical high-voltage line. The dotted line represents the axis of rotation of the screen 10, the circular bushing 15 and the circular output cable 16. An output cable 16 with a paper insulation 17, which enables the high-voltage device to be electrically connected to an external high-voltage network, in particular an HVDC transmission network, is arranged within the bushing 15. The screen 10 is arranged with respect to the almost right-angled bushing output 21 in such a way that a symmetrical covering of both angles of the bushing 15 and the tank wall 20 around the corner point of the almost right-angled bushing output 21 is guaranteed. In conjunction with the circulating oil within the electrical high-voltage device and the bushing 15, the additional barrier system 14 around the screen 10 guarantees an optimum electrical screening of the corners of the bushing output 21. Advantageously, the barrier system 14 of the screen 10 can be connected to the barrier system 14 within the bushing 15 and/or the electrical high-voltage device so that a continuous barrier system 14 is produced from the bushing output 21 right into the bushing 15.

The invention claimed is:

1. An apparatus for electrical screening of a substantially right-angled bushing output of a bushing of a high-voltage line into an outer tank wall of a tank of an electrical high-voltage device, the apparatus comprising:

an electrically conductive screen interior;

an outer insulating layer surrounding said screen interior;

a first limb and a second limb;

a curved circular segment extending around the substantially right-angled bushing output, said curved circular segment extending between the first limb and the second limb;

the first limb extending substantially parallel to an alignment of the bushing and extending around an output cable and into the bushing; and the second limb extending substantially parallel to an alignment of the tank wall and extending into the tank.

2. The apparatus according to claim 1, wherein said screen interior has a tubular cross section.

3. The apparatus according to claim 1, wherein the screening apparatus is positioned relative to the substantially right-angled bushing output to cause a radius of said curved segment to run through the substantially right angle of the bushing output.

4. The apparatus according to claim 1, wherein a radius of the curved circular segment is less than four times a length of said limbs.

5. The apparatus according to claim 1, wherein a radius of the curved circular segment is between 10 mm and 500 mm.

6. The apparatus according to claim 1, wherein a radius of the curved circular segment is 100 mm.

7. The apparatus according to claim 1, which further comprises a barrier system having at least one barrier additionally electrically insulating the screening apparatus.

8. The apparatus according to claim 7, wherein said barrier system is configured to be connected to a barrier system to be disposed within at least one of the bushing or a tank.

9. The apparatus according to claim 7, which further comprises a fixing device for connecting at least one of the screening apparatus or said barrier system to at least one of the tank wall or the bushing.

10. The apparatus according to claim 7, wherein at least one of the screening apparatus or said barrier system for the screening apparatus is formed of segments disposed at defined intervals around the bushing output.

11. The apparatus according to claim 1, wherein the screening apparatus is disposed around the bushing in the form of a solid body.

12. The apparatus according to claim 1, wherein said screen interior is connected to electrical ground and is therefore grounded.

13. The apparatus according to claim 1, wherein the screening apparatus is at least partially formed of conductive material to be partially interspersed with non-conductive material.

14. The apparatus according to claim 1, wherein the screening apparatus is formed of a non-conductive carrier material at least partially sheathed with a conductive layer.

* * * * *